US011692681B1

(12) United States Patent
Zheng et al.

(10) Patent No.: US 11,692,681 B1
(45) Date of Patent: Jul. 4, 2023

(54) PROJECTING DEVICE FOR GENERATING LIGHT EFFECT OF GALACTIC STARRY SKY AND PROJECTING LAMP

(71) Applicant: Shenzhen Bolong Technology Co. Ltd., Shenzhen (CN)

(72) Inventors: Huazhu Zheng, Shenzhen (CN); Yunyun Lu, Shenzhen (CN); Caijian Zheng, Shenzhen (CN); Wenzhen Ouyang, Shenzhen (CN)

( * ) Notice: Subject to any disclaimer, the term of this patent is extended or adjusted under 35 U.S.C. 154(b) by 0 days.

(21) Appl. No.: 17/981,324

(22) Filed: Nov. 4, 2022

(30) Foreign Application Priority Data

Sep. 30, 2022 (CN) ..... 202222637125.8

(51) Int. Cl.
*F21S 10/00* (2006.01)
*F21V 11/14* (2006.01)
*F21V 5/04* (2006.01)

(52) U.S. Cl.
CPC ..... *F21S 10/007* (2013.01); *F21V 5/04* (2013.01); *F21V 11/14* (2013.01)

(58) Field of Classification Search
CPC ..... F21S 10/007; F21S 10/00; F21V 5/008; F21V 5/04; F21V 21/30; G03B 21/142; G03B 21/20; G03B 21/006; G03B 21/2033
See application file for complete search history.

(56) References Cited

U.S. PATENT DOCUMENTS 9,194,551 B1 * 11/2015 Zhang ..... G03B 21/145
2009/0273762 A1 * 11/2009 Ohira ..... G03B 37/04 353/62
2015/0131288 A1 * 5/2015 Zhang ..... F21S 8/00 362/277
2015/0308663 A1 * 10/2015 Jurik ..... F21V 17/007 362/277
2019/0383980 A1 * 12/2019 Lu ..... G03B 21/2033
2022/0206378 A1 6/2022 Zhu et al.

FOREIGN PATENT DOCUMENTS

CN 112731751 A 4/2021
CN 213513690 U 6/2021
CN 213519178 U 6/2021
CN 214671717 U 11/2021

* cited by examiner

*Primary Examiner* — Y M. Quach Lee

(57) ABSTRACT

The utility model discloses a projecting device for generating a light effect of a galactic starry sky, including: a light-emitting assembly including at least one first incoherent light source and at least one first condensing lens, the first condensing lens being arranged on an illuminating surface of the first incoherent light source; a film assembly including a film sheet provided with a galactic starry sky pattern, the film sheet being arranged on the other side of the first condensing lens relative to the first incoherent light source; and an imaging assembly including at least three lenses, the three lenses being an imaging lens, an adjusting lens, and a wide-angle lens arranged sequentially in a projection direction of the film sheet, respectively. The technical solution of the utility model effectively improves practicality of the projecting device by setting a plurality of functional lenses.

10 Claims, 7 Drawing Sheets

PROJECTING DEVICE FOR GENERATING LIGHT EFFECT OF GALACTIC STARRY SKY AND PROJECTING LAMP

TECHNICAL FIELD

The utility model relates to the technical field of projection, and particularly to a projecting device for generating a light effect of a galactic starry sky and a projecting lamp.

BACKGROUND

A projecting lamp, also known as an imaging lamp, is an electrical device that can project an image or a word onto the ground or a wall. In daily life, the projecting lamp is used in many scenes, such as a stage, a bedroom, a vapor lamp and other places. However, since most scenes require presentation of a content of a pattern, a main R&D direction of a projecting lamp in the prior art is how to diversify the presentation of the pattern and ignore a specific effect of the pattern. Therefore, most of the projecting lamps in the prior art have low clarity or brightness of the projected pattern, which seriously affects a user's experience.

SUMMARY

A main objective of the utility model is to propose a projecting device for generating a light effect of a galactic starry sky, which aims at improving practicality of the projecting device.

To achieve the above objective, the utility model proposes a projecting device for generating a light effect of a galactic starry sky, including:

a light-emitting assembly including at least one first incoherent light source and at least one first condensing lens, the first condensing lens being arranged on an illuminating surface of the first incoherent light source;

a film assembly including a film sheet provided with a galactic starry sky pattern, the film sheet being arranged on the other side of the first condensing lens relative to the first incoherent light source; and, an imaging assembly including at least three lenses, the three lenses being an imaging lens, an adjusting lens, and a wide-angle lens arranged sequentially in a projection direction of the film sheet, respectively.

Optionally, the imaging assembly includes a first sleeve tube, and the imaging lens, the adjusting lens, and the wide-angle lens are arranged within the first sleeve tube.

Optionally, the light-emitting assembly further includes a second condensing lens, and the second condensing lens is arranged on the other side of the first condensing lens relative to the first incoherent light source.

Optionally, the film assembly further includes a rotating plate and a pressing plate. The rotating plate is opened and provided with a fixing groove. The film sheet and the pressing plate are fixedly arranged in the fixing groove, and the rotating plate and the pressing plate are made of a transparent material.

Optionally, the projecting device further includes a first driving assembly, and the first driving assembly is configured to drive the rotating plate to rotate.

Optionally, the first incoherent light source, the first condensing lens, the film sheet, and the imaging assembly are arranged coaxially.

The utility model also proposes a projecting lamp, including:

a first housing opened and provided with a first mounting hole;

a light-emitting assembly arranged within the first housing, the light-emitting assembly including at least one first incoherent light source and at least one first condensing lens, and the first condensing lens being arranged on an illuminating surface of the first incoherent light source;

a film assembly arranged within the first mounting hole, the film assembly including a film sheet provided with a galactic starry sky pattern, and the film sheet being arranged on the other side of the first condensing lens relative to the first incoherent light source; and an imaging assembly arranged within the first housing, the imaging assembly including at least three lenses, the three lenses being an imaging lens, an adjusting lens, and a wide-angle lens arranged sequentially in a projection direction of the film sheet, respectively Optionally, the film assembly includes a second housing and a film tray. The film sheet is arranged on the film tray. The second housing corresponding to the position of first mounting hole is fixed in the first housing, and the film tray is inserted in the first mounting hole and extends into the second housing.

Optionally, the imaging assembly includes a first sleeve tube, and the imaging lens, the adjusting lens, and the wide-angle lens are arranged within the first sleeve tube;

a top of the second housing is provided with a fixing boss, the first sleeve tube is threadedly connected to the fixing boss to reciprocate the first sleeve tube relative to the fixing boss in an axial extension direction of the first sleeve tube.

Optionally, the first housing includes a mounting shell and a covering plate arranged on the mounting shell. The first mounting hole is opened and provided at a side wall of the mounting shell, and the covering plate is opened and provided with a second mounting hole;

the projecting lamp further includes a lens encasing, the lens encasing is arranged in the second mounting hole, an outer wall of the first sleeve tube is opened and provided with a card slot, an inner wall of the lens encasing is provided with a card block that cooperates with the card slot, the lens encasing is covered and arranged on the first sleeve tube, and the card block is located in the card slot.

Optionally, the film assembly further includes a rotating plate and a pressing plate. The rotating plate is opened and provided with a fixing groove. The film sheet and the pressing plate are fixedly arranged in the fixing groove. The rotating plate and the pressing plate are made of a transparent material. The film tray is opened and provided with a mounting groove, and the rotating plate is arranged in the mounting groove.

Optionally, the projecting lamp further includes a first driving assembly arranged in the mounting shell. The first driving assembly includes a motor, a fixing plate, and a gear set. The fixing plate is fixed in the first housing. The motor is fixed on the fixing plate, and a sidewall of the rotating plate is arranged in a tooth shape that engages with the gear set to cause the motor to drive the rotating plate to rotate via the gear set.

Optionally, the first driving assembly is arranged below the first incoherent light source. The first driving assembly further includes a rotating shaft fixed at one end on the fixing plate and at the other end on the second housing. The gear set includes a driving gear arranged on a motor shaft of the motor, a first transmission gear sleeved on the rotating shaft and meshed with the driving gear, and a second transmission gear sleeved on the rotating shaft and fixedly connected to the first transmission gear. The second transmission gear is meshed with the rotating plate, and the second transmission gear has the number of teeth less than that of the first transmission gear.

Optionally, the second housing includes an upper housing and a lower housing. The film tray and the lower housing are opened and provided with a position-avoidance groove for avoiding a position of the second transmission gear, and the rotating shaft passes through the position-avoidance groove and is fixed on the upper housing;

a bottom wall of the mounting groove is provided with a limiting ring, and the rotating plate is opened and provided with a limiting guide rail cooperating with the limiting ring.

Optionally, the light-emitting assembly further includes a second condensing lens, and the second condensing lens is arranged on the other side of the first condensing lens relative to the first incoherent light source.

Optionally, the light-emitting assembly further includes a second sleeve tube. The second sleeve tube is sleeved on the first incoherent light source, and the first condensing lens and the second condensing lens are arranged within the second sleeve tube.

Optionally, the projecting lamp further includes a laser assembly. The laser assembly includes at least one coherent light source, at least one diffraction medium, and a second driving assembly for driving the diffraction medium to rotate, and the diffraction medium is arranged on an illuminating surface of the coherent light source.

Optionally, the projecting lamp further includes a bracket, and the first housing is rotatably connected to the bracket.

For the technical solution of the utility model, the first condensing lens is arranged on the illuminating surface of the first incoherent light source. The film sheet is arranged on the other side of the first condensing lens relative to the first incoherent light source. The imaging assembly is arranged on the other side of the film sheet relative to the first condensing lens. The imaging assembly includes at least three lenses. The three lenses are the imaging lens, the adjusting lens, and the wide-angle lens arranged sequentially in the projection direction of the film sheet. It should be explained that the imaging lens is configured to collect light spots of an effective pattern passing through the film sheet, thereby forming a real image pattern to be projected onto the adjusting lens. The adjusting lens is configured to reform, correct and project the real image onto the wide-angle lens. The wide-angle lens is configured to magnify and project the adjusted real image pattern onto a light-shadow bearing surface, thereby exhibiting a clearly enlarged pattern effect on the light-shadow bearing surface. The plurality of lens with different functions are arranged, thereby effectively improving clarity of the projected pattern of the projecting device, and effectively improving practicality of the projecting device.

BRIEF DESCRIPTION OF THE DRAWINGS

In order to explain embodiments of the utility model or the technical solutions in the prior art more clearly, the following briefly introduces the drawings that need to be used in the description of the embodiments or the prior art. Obviously, the drawings in the following description are only some of the embodiments of the utility model. The person skilled in the art may obtain other drawings based on structures shown in these drawings without creative labor.

Figure 1:
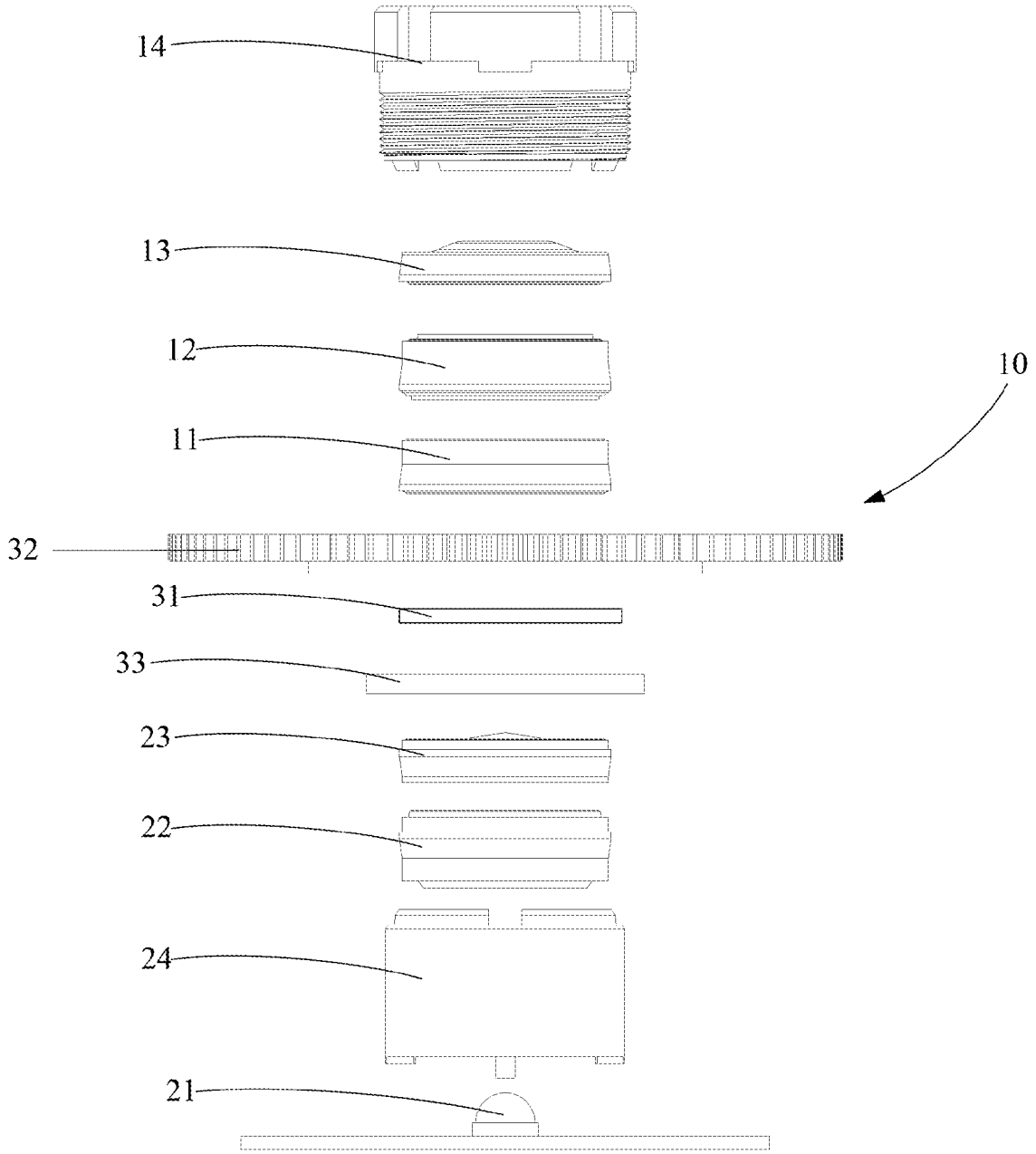
FIG. 1 is a schematic structural diagram of a projecting device of the utility model.

Description of reference signs:

| Reference signs | Name(s) | Reference signs | Name(s) |
|---|---|---|---|
| 10 | Projecting device | 31 | Film sheet |
| 11 | Imaging lens | 32 | Rotating plate |
| 12 | Adjusting lens | 322 | Fixing column |
| 13 | Wide-angle lens | 323 | Limiting guide rail |
| 14 | First sleeve tube | 33 | Pressing plate |
| 141 | Card slot | 341 | Upper housing |
| 21 | First incoherent light source | 342 | Lower housing |
| 22 | First condensing lens | 343 | Fixing boss |
| 23 | Second condensing lens | 35 | Film tray |
| 24 | Second sleeve tube | 351 | Mounting groove |
| 41 | Motor | 352 | Position-avoidance groove |
| 42 | Fixing plate | 36 | Limiting ring |
| 43 | Driving gear | 51 | Mounting shell |
| 44 | First transmission gear | 511 | First mounting hole |
| 45 | Second transmission gear | 52 | Covering plate |
| 46 | Rotating shaft | 521 | Second mounting hole |
| 60 | Lens encasing | 70 | Bracket |
| 61 | Card block | 80 | Loudspeaker |
| | | 81 | Loudspeaker hole |

The realization of the objective, functional characteristics and advantages of the utility model will be further described with reference to the drawings in conjunction with the embodiments.

DETAILED DESCRIPTION OF EMBODIMENTS

The following clearly and completely describes the technical solutions in embodiments of the utility model in conjunction with the drawings in the embodiments of the utility model. Obviously, the described embodiments are only a part of the embodiments of the utility model, rather than all embodiments. Based on the embodiments of the utility model, all other embodiments obtained by the person skilled in the art without creative labor shall fall within the protection scope of the utility model.

It should be noted that if the embodiments of the utility model involve directional indications (such as up, down, left, right, front, back . . . ), the directional indications are only used to explain a relative position relationship and movement among various components under a certain posture (as shown in the accompanying drawings). If a specific posture changes, the directional indication also changes accordingly.

In addition, if there are descriptions of terms such as "first", "second" and the like in the embodiments of the utility model, the descriptions of the terms such as "first", "second" and the like are merely intended for a purpose of description, and shall not be understood as an indication or implication of relative importance or implicit indication of a quantity of indicated technical features. Therefore, the features defined with "first" and "second" may explicitly or implicitly include at least one of the features. In addition, the meaning of "and/or" in the whole text is to include three parallel schemes. Taking "A and/or B" as an example, "A and/or B" includes scheme A, scheme B, or a scheme that A and B are satisfied at the same time. In addition, the technical solutions between the various embodiments may be combined with each other, but should be based on what may be achieved by those skilled in the art. When a combination of technical solutions is contradictory or cannot be achieved, it should be considered that such a combination of technical solutions does not exist, and also does not fall within the scope of protection required by the utility model.

The utility model proposes a projecting device 10 for generating a light effect of a galactic starry sky.

Figure 7:
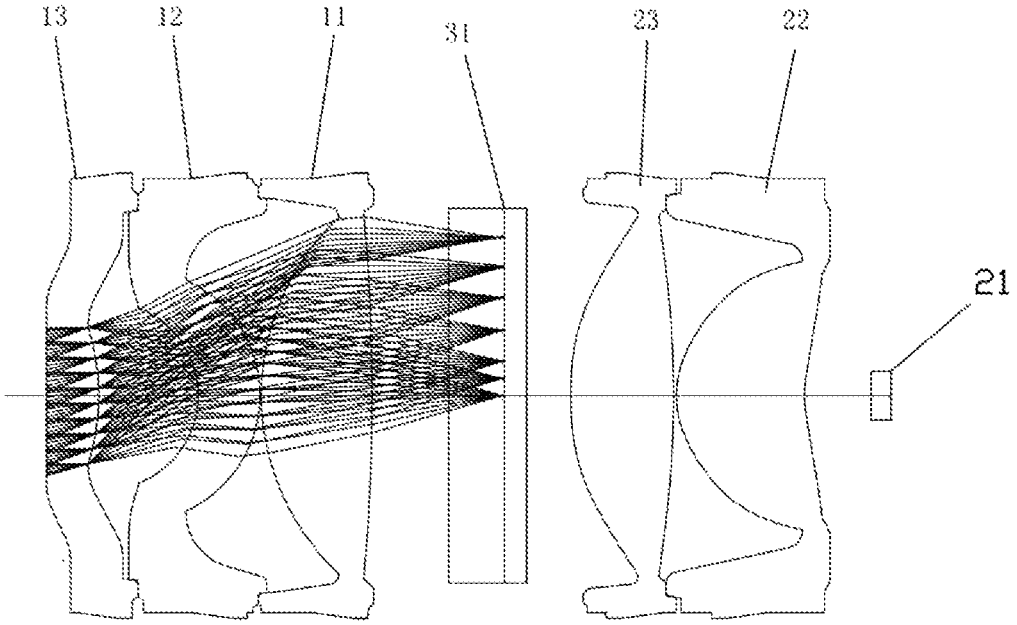
FIG. 7 is a schematic diagram of an optical principle of a projecting device of the utility model.

In the embodiment of the utility model, as shown in FIGS. 1 and 7, the projecting device 10 includes:

a light-emitting assembly including at least one first incoherent light source 21 and at least one first condensing lens 22, the first condensing lens 22 being arranged on an illuminating surface of the first incoherent light source 21;

a film assembly including a film sheet 31 provided with a galactic starry sky pattern, the film sheet 31 being arranged on the other side of the first condensing lens 22 relative to the first incoherent light source 21; and, an imaging assembly including at least three lenses, the three lenses being an imaging lens 11, an adjusting lens 12, and a wide-angle lens 13 arranged sequentially in a projection direction of the film sheet 31, respectively.

In this embodiment, the first incoherent light source 21 is a light-emitting member of the projecting device 10, and configured to illuminate and project a pattern onto a light-shadow bearing surface. The plurality of first incoherent light sources 21 can be arranged to improve intensity of a light ray. The first condensing lens 22 is configured to focus a light ray emitted by the first incoherent light source 21 to improve intensity of the light ray, and is arranged on the illuminating surface of the first incoherent light source 21.

The film sheet 31 is a pattern bearing member of the projecting device 10. A pattern similar to a galactic starry sky is arranged on the film sheet 31, and arranged on the other side of the first condensing lens 22 relative to the first incoherent light source 21, so that when the first condensing lens 22 projects the focused light ray onto the film sheet 31, the galactic starry sky pattern on the film sheet 31 is mapped onto the light-shadow bearing surface. Therefore, the light-shadow bearing surface exhibits the effect of the galactic starry sky.

The imaging assembly is configured to process light spots of a pattern passing through the film sheet 31 to present the pattern on the film sheet 31 clearly and completely on the light-shadow bearing surface. Specifically, the imaging lens 11, the adjusting lens 12, and the wide-angle lens 13 are arranged sequentially in the projection direction of the film sheet 31. The imaging lens 11 is configured to collect the light spots of the effective pattern passing through the film sheet 31, thereby forming and projecting a real image pattern to the adjusting lens 12. The adjusting lens 12 then reforms, corrects and projects the real image pattern onto the wide-angle lens 13. The wide-angle lens 13 magnifies and projects the adjusted real image pattern onto the light image bearing surface, thereby exhibiting a clearly enlarged pattern effect on the light image bearing surface.

It should be explained that the first incoherent light source 21, the first condensing lens 22, the film sheet 31, and a lens of the imaging assembly are all arranged coaxially, so that loss of the light ray emitted by the first incoherent light source 21 can be effectively reduced, thereby improving brightness of the projected pattern of the projecting device 10.

For the technical solution of the utility model, the first condensing lens 22 is arranged on the illuminating surface of the first incoherent light source 21. The film sheet 31 is arranged on the other side of the first condensing lens 22 relative to the first incoherent light source 21. The imaging assembly is arranged on the other side of the film sheet 31 relative to the first condensing lens 22. The imaging assembly includes at least three lenses. The three lenses are the imaging lens 11, the adjusting lens 12, and the wide-angle lens 13 arranged sequentially in the projection direction of the film sheet 31. It should be explained that the imaging lens 11 is configured to collect the light spots of the effective pattern passing through the film sheet 31, thereby forming the real image pattern to be projected onto the adjusting lens 12. The adjusting lens 12 is configured to reform, correct and project the real image onto the wide-angle lens 13. The wide-angle lens 13 is configured to magnify and project the adjusted real image pattern onto the light-shadow bearing surface, thereby exhibiting the clearly enlarged pattern effect on the light-shadow bearing surface. The plurality of lens with different functions are arranged, thereby effectively improving clarity of the projected pattern of the projecting device 10, and effectively improving practicality of the projecting device 10.

Further, as shown in FIG. 1, the imaging assembly includes a first sleeve tube 14, and the imaging lens 11, the adjusting lens 12, and the wide-angle lens 13 are arranged within the first sleeve tube 14. In this embodiment, the first sleeve tube 14 is configured to fix the imaging lens 11, the adjusting lens 12, and the wide-angle lens 13 so that the imaging lens 11, the adjusting lens 12, and the wide-angle lens 13 are always on the same axis. Therefore, a change in a relative position of the imaging lens 11, the adjusting lens 12, or the wide-angle lens 13 is avoided when the projecting device 10 is subjected to an external force, which further affects the projecting effect of the projecting device 10. This thus effectively improves structural stability of the projecting device 10.

In addition, the imaging lens 11, the adjusting lens 12, and the wide-angle lens 13 are aspherically designed lenses, and a first abutting boss is arranged on sides of the imaging lens 11, the adjusting lens 12 and the wide-angle lens 13. The first abutting boss has a height greater than a thickness of a middle of each of the lenses, thereby effectively preventing each of the lenses from having friction or collision within the first sleeve tube 14, which affects the projecting effect of the projecting device 10.

A bottom of the first sleeve tube 14 is also provided with an abutting member for abutting against the imaging lens 11. The abutting member is provided with a bearing boss. The abutting member is fixed to the first sleeve tube 14 for abutment, and the bearing boss is located within the first sleeve tube 14 to bear the imaging lens 11, thereby preventing a bearing lens from being slipped out of the first sleeve tube 14.

Further, as shown in FIGS. 1 and 7, the light-emitting assembly further includes a second condensing lens 23, and the second condensing lens 23 is arranged on the other side of the first condensing lens 22 relative to the first incoherent light source 21. In this embodiment, the first condensing lens 22 is configured to converge the light ray emitted by the first incoherent light source 21 to improve the intensity of the light ray. The second condensing lens 23 is arranged on the other side of the first condensing lens 22 relative to the first incoherent light source 21, and configured to refract the light ray converged by the first condensing lens 22 again to uniformly project the light ray onto the film sheet 31, so as to avoid that the pattern on the film sheet 31 differs locally due to the different intensities of the light ray, which affects the projecting effect of the projecting device 10. Therefore, this effectively improves practicality of the projecting device 10.

In addition, the light-emitting assembly further includes a second sleeve tube 24 arranged on the first incoherent light source 21. The first condensing lens 22 and the second condensing lens 23 are arranged within the second sleeve tube 24. Both of the first condensing lens 22 and the second condensing lens 23 are aspherically designed lenses. A second abutting boss is arranged on sides of the first condensing lens 22 and the second condensing lens 23. The second abutting boss has a height greater than a thickness of middles of the first condensing lens 22 and the second condensing lens 23.

Further, as shown in FIG. 1, the film assembly further includes a rotating plate 32 and a pressing plate 33. The rotating plate 32 is opened and provided with a fixing groove. The film sheet 31 and the pressing plate 33 are fixedly arranged in the fixing groove. The rotating plate 32 and the pressing plate 33 are made of a transparent material. In this embodiment, the rotating plate 32 and the pressing plate 33 are configured to fix the film sheet 31. Specifically, the film sheet 31 is arranged in the fixing groove, and the pressing plate 33 is arranged on the film sheet 31. The pressing plate 33 and the rotating plate 32 are packaged through a press-fitting process, thereby dividing the film sheet 31 from contacting with air, preventing the pattern on the film sheet 31 from being oxidized, and effectively improving a service life of the film sheet 31.

It should be explained that the rotating plate 32 and the pressing plate 33 are made of the transparent material, thereby enabling the light ray to pass through the rotating plate 32 and the pressing plate 33 to project the pattern on the film sheet 31.

In addition, a fixing column 322 is arranged in the fixing groove. The film sheet 31 and the pressing plate 33 are opened and provided with a positioning hole cooperating with the fixing column 322, thereby effectively improving assembly efficiency of the film assembly.

The projecting device 10 further includes a first driving assembly. The first driving assembly is configured to drive the rotating plate 32 to rotate, thereby rendering the light and shadows projected by the projecting device 10 to exhibit a dynamic effect, and effectively improving diversity of the light effect of the projecting device 10.

Figure 2:
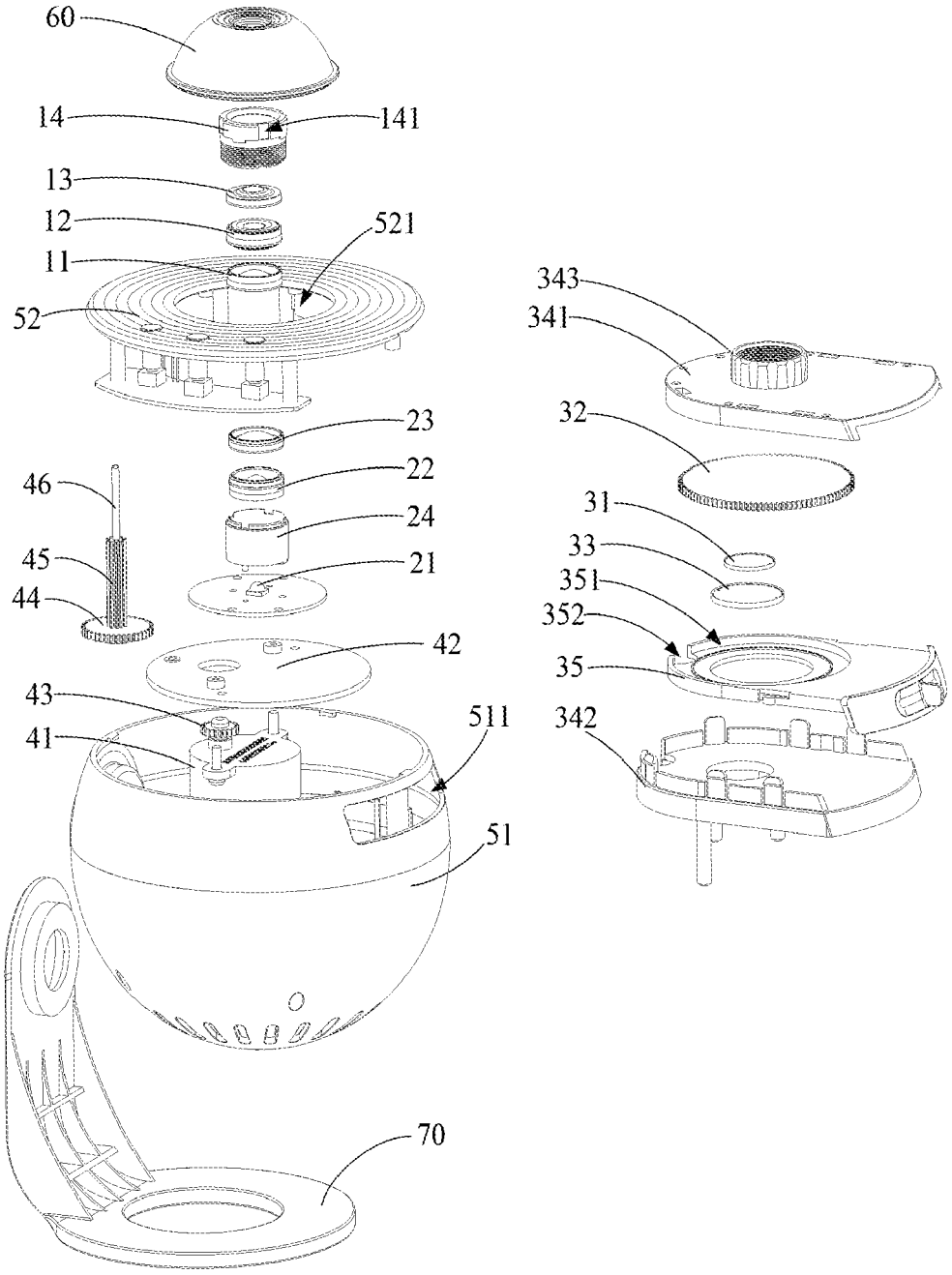
FIG. 2 is a schematic structural diagram of an exploded state of the projecting lamp of the utility model.

The utility model also proposes a projecting lamp. As shown in FIG. 2, the projecting lamp includes a first housing, a light-emitting assembly, a film assembly, and an imaging assembly 11. Specific structures of the light-emitting assembly, the film assembly, and the imaging assembly 11 refer to the above embodiments. Since the projecting lamp adopts all the technical solutions of all the above embodiments, the light-emitting assembly, the film assembly, and the imaging lens 11 have at least all beneficial effects of the technical solutions of the above embodiments, which will not be described again here. The first housing is opened and provided with a first mounting hole 511. The film assembly is arranged within the first mounting hole 511. The light-emitting assembly and the film assembly are arranged within the first housing.

Further, as shown in FIGS. 2 to 6, the film assembly includes a second housing and a film tray 35. The film sheet 31 is arranged on the film tray 35. The second housing corresponding to the position of first mounting hole 511 is fixed in the first housing, and the film tray 35 is inserted in the first mounting hole 511 and extends into the second housing. In this embodiment, the second housing is configured to provide the film tray 35 with a movable mounting position. Specifically, the second housing is fixed in the first housing and arranged at a position corresponding to the first mounting hole 511. The film tray 35 can be movably inserted into the second housing via the first mounting hole 511 so that a user can change the film sheet 31 at any time according to a use scene, thereby making the projecting lamp be suitable for more scenes, and thus effectively improving practicality of the projecting lamp.

It should be explained that when the film tray 35 is inserted into the second housing, a light transmitting hole is arranged at a position of the second housing corresponding to the film tray 31, so that the light ray reflected by the first condensing lens 22 can accurately illuminate onto the film tray 31.

Further, as shown in FIGS. 2 to 5, the imaging assembly includes a first sleeve tube 14. The imaging lens 11, the adjusting lens 12, and the wide-angle lens 13 are arranged within the first sleeve tube 14. A top of the second housing is provided with a fixing boss 343. The first sleeve tube 14 is threadedly connected to the fixing boss 343 to reciprocate the first sleeve tube 14 relative to the fixing boss 343 in an axial extension direction of the first sleeve tube 14. In this embodiment, an outer wall surface of the first sleeve 14 is provided with outer threads. An inner wall surface of the fixing boss 343 is provided with inner threads that cooperates with the first sleeve tube 14. The first sleeve tube 14 is threadedly connected to the fixing boss 343, so that the first sleeve tube 14 moves back and forth in an axial direction of the first sleeve tube 14 relative to the fixing boss 343 when being rotated clockwise or counterclockwise. It can be understood that an image projected by the imaging assembly is made clearer by adjusting a distance between the first sleeve tube and the film sheet 31.

Further, the first housing includes a mounting shell 51 and a covering plate 52 arranged on the mounting shell 51. The first mounting hole 511 is opened and provided on a side wall of the mounting shell 51. The covering plate 52 is opened and provided with the second mounting hole 521. The projecting lamp further includes a lens encasing 60. The lens encasing 60 is arranged in the second mounting hole 521. An outer wall of the first sleeve tube 14 is opened and provided with a card slot 141. An inner wall of the lens encasing 60 is provided with a card block 61 that cooperates with the card slot 141. The lens encasing 60 is covered and arranged on the first sleeve tube 14, and the card block 61 is located in the card slot 141. In this embodiment, the mounting shell 51 is configured to provide a mounting space for the projecting device 10. The covering plate 52 is configured to fix the lens encasing 60. Specifically, the covering plate 52 is opened and provided with a second mounting hole 521. One end of the lens encasing 60 extends out of the first housing from the second mounting hole 521, and the other end thereof abuts against an inner wall of the covering plate 52 to be fixed in the second mounting hole 521. Additionally, the card block 61 arranged on the inner wall of the lens encasing 60 is inserted into the card slot 141 at the outer wall of the first sleeve tube 14, so that the user can rotate the lens encasing 60 to drive the first sleeve tube 14 to rotate, and then adjust a focal length of the imaging lens 11 to present a clear image content on a light bearing surface.

Further, as shown in FIGS. 2 to 5, the film assembly further includes a rotating plate 32 and a pressing plate 33. The rotating plate 32 is opened and provided with a fixing groove. The film sheet 31 and the pressing plate 33 are fixedly arranged in the fixing groove. The rotating plate 32 and the pressing plate 33 are made of the transparent material. The film tray 35 is opened and provided with a mounting groove 351, and the rotating plate 32 is arranged in the mounting groove 351. In this embodiment, the mounting groove 351 is arranged by corresponding to a position of the first condensing lens 22. The rotating plate 32 is arranged in the mounting groove 351, which can effectively avoid a mistaken installation of the rotating plate 32, thereby affecting a projection effect of the projecting lamp because the film sheet 31 does not correspond to a first condensing light projection.

It should be noted that a position of the mounting groove 351 corresponding to the film sheet 31 is opened and provided with the light transmitting hole so that the light ray reflected by the first condensing lens 22 can accurately illuminate the film sheet 31.

Figure 3:
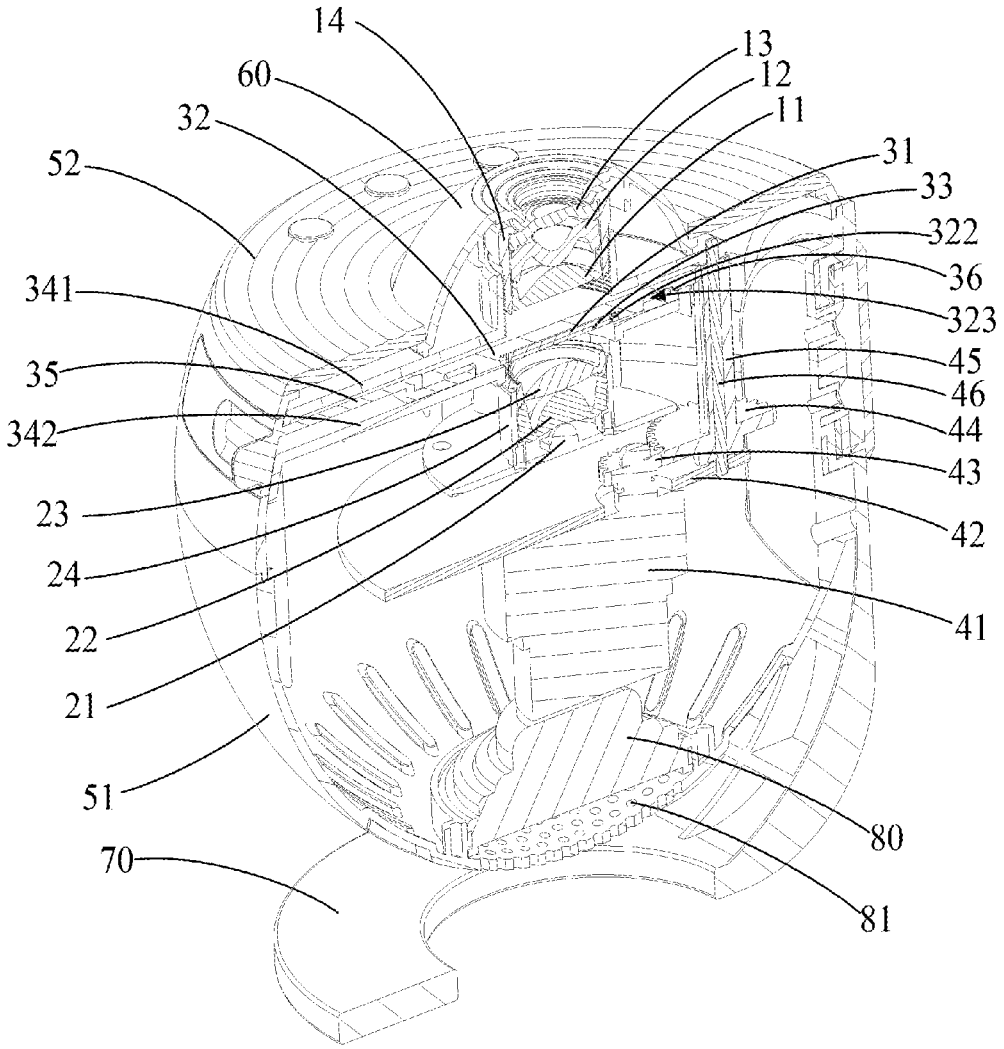
FIG. 3 is a sectional view of a projecting lamp of the utility model.
Figure 5:
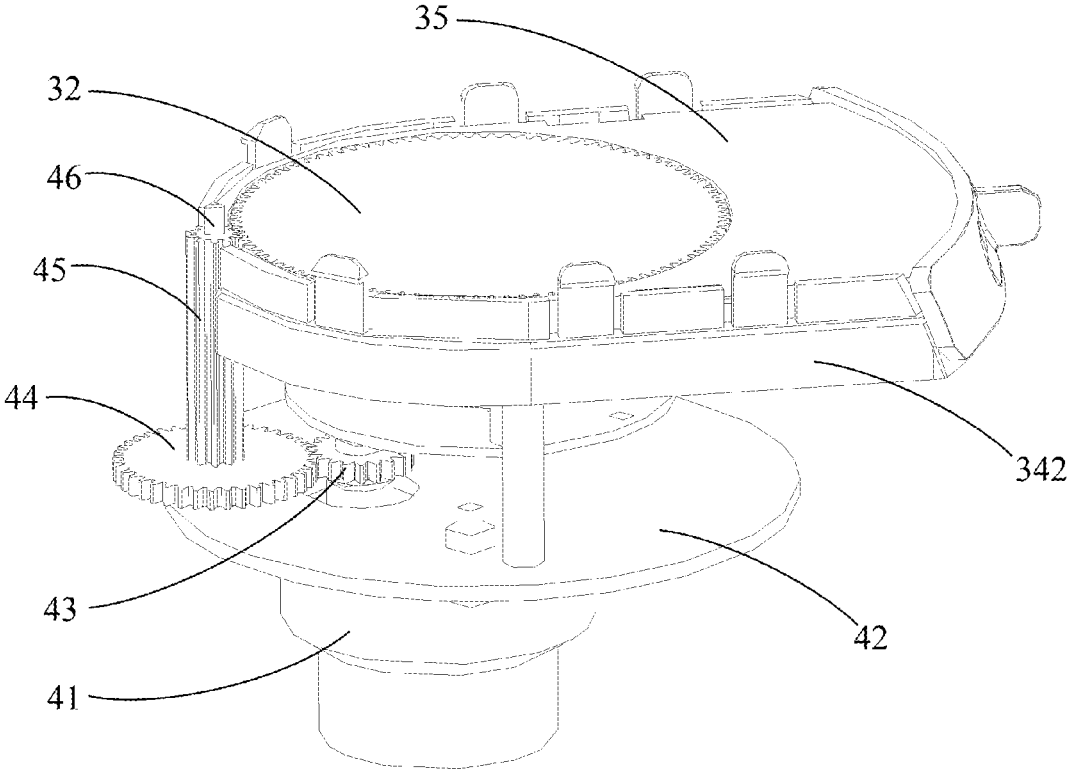
FIG. 5 is a schematic structural diagram of a first driving assembly of a projecting lamp of the utility model.
Figure 6:
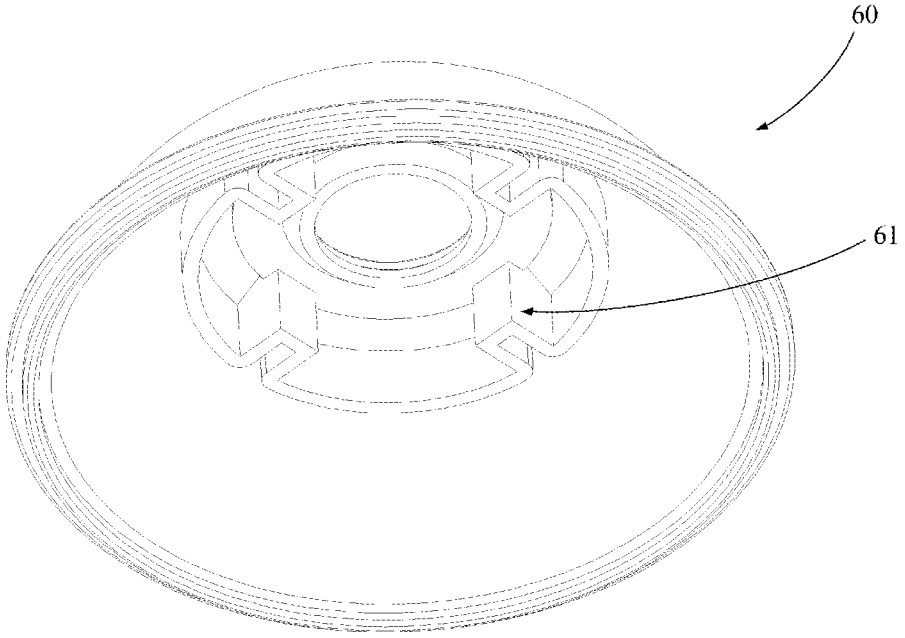
FIG. 6 is a schematic structural diagram of a lens encasing of a projecting lamp of the utility model.

Further, as shown in FIGS. 2, 3, and 5, the projecting lamp further includes a first driving assembly arranged in the mounting shell 51. The first driving assembly includes a motor 41, a fixing plate 42, and a gear set. The fixing plate 42 is fixed in the first housing. The motor 41 is fixed on the fixing plate 42, and a sidewall of the rotating plate 32 is arranged in a tooth shape that engages with the gear set to cause the motor 41 to drive the rotating plate 32 to rotate via the gear set. In this embodiment, the first driving assembly is configured to drive the rotating plate 32 to rotate, so that the light effect of the galactic starry sky projected by the projecting lamp becomes dynamic, thereby improving diversity of the light effect projected by the projecting lamp. Specifically, the fixing plate 42 is arranged in the first housing for fixing the motor 41. The gear set is arranged on the motor 41. Additionally, the sidewall of the rotating plate 32 is arranged in a tooth shape. The motor 41 drives the rotating plate 32 via the gear set to rotate, thereby forming a dynamic lighting effect.

Further, the first driving assembly is arranged below the first incoherent light source 21. The first driving assembly further includes a rotating shaft 46 fixed at one end on the fixing plate 42 and at the other end on the second housing. The gear set includes a driving gear 43 arranged on a motor 41 shaft of the motor 41, a first transmission gear 44 sleeved on a rotating shaft 46 and meshed with the driving gear 43, and a second transmission gear 45 sleeved on the rotating shaft 46 and fixedly connected to the first transmission gear 44. The second transmission gear 45 is meshed with the rotating plate 32, and the second transmission gear 45 has the number of teeth less than that of the first transmission gear 44. In this embodiment, the first driving assembly may be arranged on a peripheral side of the first incoherent light source 21, or may be arranged below the first incoherent light source 21. Preferably, the first driving assembly is arranged below the first incoherent light source 21, thereby effectively reducing an occupied area of the projecting lamp and thus saving a space. The second transmission gear 45 has the number of teeth less than that of the first transmission gear 44, so that a transmission ratio of the second transmission gear 45 is smaller. Additionally, the rotating plate 32 has the number of teeth more than that of the second transmission gear 45, so that the second rotating gear drives the rotating plate 32 to rotate at a very slow speed, which is closer to an effect of actual rotation of a starry sky. This can effectively improve the user's experience.

Further, the second housing includes an upper housing 341 and a lower housing 342. The film tray 35 and the lower housing 342 are opened and provided with a position-avoidance groove 352 for avoiding a position of the second transmission gear 45. The rotating shaft 46 passes through the position-avoidance groove 352 and is fixed on the upper housing 341. A bottom wall of the mounting groove 351 is provided with a limiting ring 36. The rotating plate 32 is opened and provided with a limiting guide rail 323 cooperating with the limiting ring 36. In this embodiment, the upper housing 341 is snap-connected to the lower housing 342 to form a mounting space for mounting the film tray 35. The lower housing 342 and the film tray 35 are provided with the position-avoidance groove 352 for maintaining the second transmission gear 45 and the rotating plate 32 to be effectively meshed. The limiting ring 36 is configured to prevent the rotating plate 32 from being moved in a horizontal direction during rotation, thereby causing the pattern projected by projecting lamp to be shaken, and affecting the projection effect. Therefore, this effectively improves the practicality of the projecting lamp.

It should be explained that the limiting ring 36 abuts against an inner wall surface of the limiting guide rail 323.

Further, the projecting lamp further includes a laser assembly. The laser assembly includes at least one coherent light source, at least one diffraction medium, and a second driving assembly for driving the diffraction medium to rotate, and the diffraction medium is arranged on an illuminating surface of the coherent light source. In the embodiment, the laser assembly is configured to project another light effect. Specifically, the diffraction medium is arranged on the illuminating surface of the coherent light source. When the light ray emitted by the coherent light source passes through the diffraction medium, a light effect similar to a star is exhibited on the light source bearing surface. Additionally, the second driving assembly drives the diffraction medium to rotate, thereby making the light effect similar to the star appear as a dynamic moving light effect of the starry sky, thus effectively improving light effect diversity of the projecting lamp.

Figure 4:
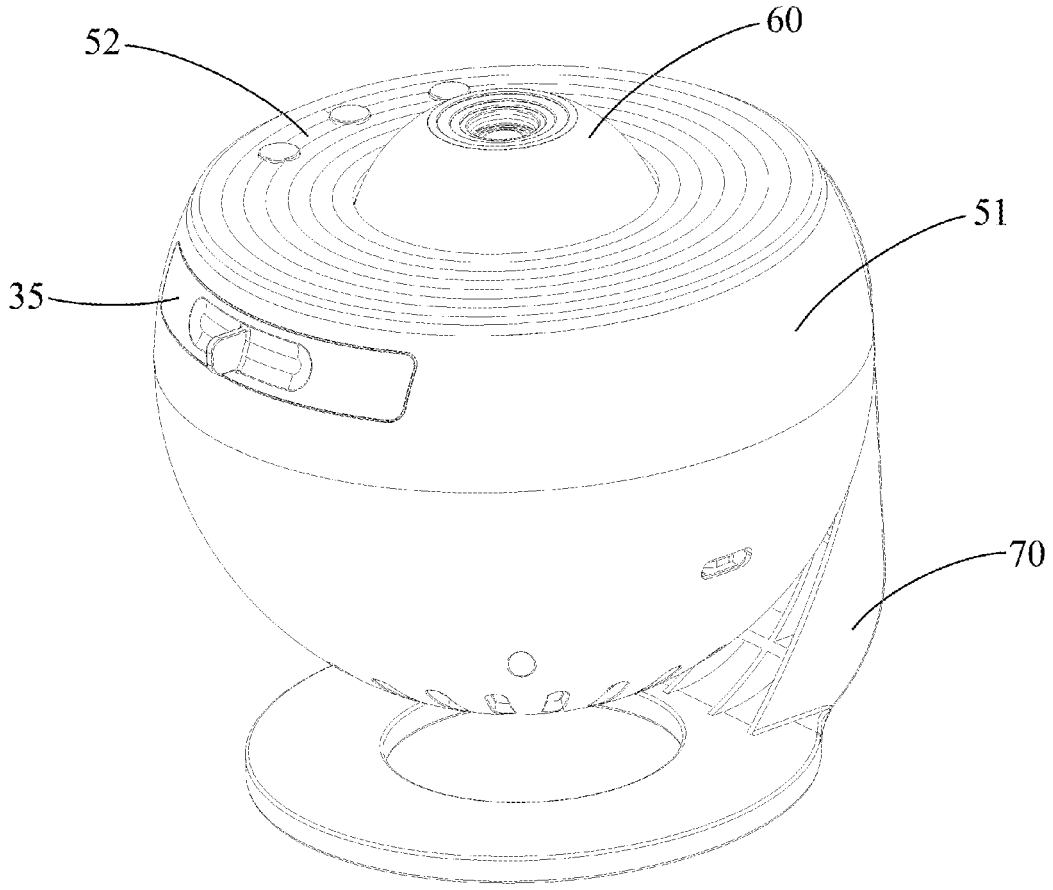
FIG. 4 is a schematic structural diagram of a projecting lamp of the utility model.

Further, as shown in FIGS. 2 and 4, the projecting lamp further includes a bracket 70. The first housing is rotatably connected to the bracket 70. In this embodiment, the bracket 70 is configured to support the first housing. The first housing is rotatably connected to the bracket 70 via a rotating assembly, thereby making it convenient for the user to adjust a projecting angle of the projecting lamp, which effectively improves the practicality of the projecting lamp.

In addition, the projecting lamp further includes an audio module arranged within the first housing and a loudspeaker 80 electrically connected to the audio module. The loudspeaker 80 is fixed to an inner wall of the first housing. A position of the first housing corresponding to the speaker 80 is opened and provided with a loudspeaker hole 81, so that the projecting lamp also has an audio playback function, which effectively improves functional diversity of the projecting lamp.

The forgoing is only a preferred embodiment of the utility model, and is not intended to limit the patent scope of the utility model. Under the inventive concept of the utility model, an equivalent structure variation made by the contents of the description and drawings of the utility model directly/indirectly applied to other related arts is included in the scope of patent protection of the utility model.

What is claimed is:

1. A projecting lamp, comprising:

a first housing opened and provided with a first mounting hole;

a light-emitting assembly arranged within the first housing, the light-emitting assembly comprising at least one first incoherent light source and at least one first condensing lens, and the first condensing lens being arranged on an illuminating surface of the first incoherent light source;

a film assembly arranged within the first mounting hole, the film assembly comprising a film sheet provided with a galactic starry sky pattern, and the film sheet being arranged on the other side of the first condensing lens relative to the first incoherent light source; and an imaging assembly arranged within the first housing, the imaging assembly comprising at least three lenses, the three lenses being an imaging lens, an adjusting lens, and a wide-angle lens arranged sequentially in a projection direction of the film sheet, respectively;

the film assembly comprises a second housing and a film tray, the film sheet is arranged on the film tray, the second housing corresponding to the position of first mounting hole is fixed in the first housing, and the film tray is inserted in the first mounting hole and extends into the second housing.

2. The projecting lamp according to claim 1, wherein the imaging assembly comprises a first sleeve tube, and the imaging lens, the adjusting lens, and the wide-angle lens are arranged within the first sleeve tube;

a top of the second housing is provided with a fixing boss, the first sleeve tube is threadedly connected to the fixing boss to reciprocate the first sleeve tube relative to the fixing boss in an axial extension direction of the first sleeve tube.

3. The projecting lamp according to claim 2, wherein the first housing comprises a mounting shell and a covering plate arranged on the mounting shell, the first mounting hole is opened and provided at a sidewall of the mounting shell, and the covering plate is opened and provided with a second mounting hole;

the projecting lamp further comprises a lens encasing, the lens encasing is arranged in the second mounting hole, an outer wall of the first sleeve tube is opened and provided with a card slot, an inner wall of the lens encasing is provided with a card block that cooperates with the card slot, the lens encasing is covered and arranged on the first sleeve tube, and the card block is located in the card slot.

4. The projecting lamp according to claim 1, wherein the film assembly further comprises a rotating plate and a pressing plate; the rotating plate is opened and provided with a fixing groove, a fixing column is arranged in the fixing groove: the film sheet and the pressing plate are fixedly arranged in the fixing column, the rotating plate and the pressing plate are made of a transparent material, the film tray is opened and provided with a mounting groove, and the rotating plate is arranged in the mounting groove.

5. The projecting lamp according to claim 1, wherein the projecting lamp further comprises a first driving assembly arranged in the mounting shell, the first driving assembly comprises a motor, a fixing plate, and a gear set, the fixing plate is fixed in the first housing, the motor is fixed on the fixing plate, and a sidewall of the rotating plate is arranged in a tooth shape that engages with the gear set to cause the motor to drive the rotating plate to rotate via the gear set.

6. The projecting lamp according to claim 5, wherein the first driving assembly is arranged below the first incoherent light source, the first driving assembly further comprises a rotating shaft fixed at one end on the fixing plate and at the other end on the second housing, the gear set comprises a driving gear arranged on a motor shaft of the motor, a first transmission gear sleeved on the rotating shaft and meshed with the driving gear, and a second transmission gear sleeved on the rotating shaft and fixedly connected to the first transmission gear, the second transmission gear is meshed with the rotating plate, and the second transmission gear has the number of teeth less than that of the first transmission gear.

7. The projecting lamp according to claim 6, wherein the second housing comprises an upper housing and a lower housing, the film tray and the lower housing are opened and provided with a position-avoidance groove for avoiding a position of the second transmission gear, and the rotating shaft passes through the position-avoidance groove and is fixed on the upper housing;

a bottom wall of the mounting groove is provided with a limiting ring, and the rotating plate is opened and provided with a limiting guide rail cooperating with the limiting ring.

8. The projecting lamp according to claim 1, wherein the light-emitting assembly further comprises a second condensing lens, and the second condensing lens is arranged on the other side of the first condensing lens relative to the first incoherent light source.

9. The projecting lamp according to claim 8, wherein the light-emitting assembly further comprises a second sleeve tube, the second sleeve tube is sleeved on the first incoherent light source, and the first condensing lens and the second condensing lens are arranged within the second sleeve tube.

10. The projecting lamp according to claim 1, further comprising a bracket, the first housing being rotatably connected to the bracket.

* * * * *